US006851145B2

(12) United States Patent
Smith et al.

(10) Patent No.: US 6,851,145 B2
(45) Date of Patent: Feb. 8, 2005

(54) PACKABLE EMERGENCY TRAUMA STRETCHER

(75) Inventors: J. Shelby Smith, Albuquerque, NM (US); Jeffrey Scott McBrayer, Rio Rancho, NM (US); Eleanor L. Schuler, Rio Rancho, NM (US)

(73) Assignee: Science Medicus, Inc., Albuquerque, NM (US)

( * ) Notice: Subject to any disclaimer, the term of this patent is extended or adjusted under 35 U.S.C. 154(b) by 0 days.

(21) Appl. No.: 10/269,435

(22) Filed: Oct. 11, 2002

(65) Prior Publication Data

US 2003/0070234 A1 Apr. 17, 2003

Related U.S. Application Data

(60) Provisional application No. 60/328,382, filed on Oct. 11, 2001.

(51) Int. Cl.[7] ..... A61G 1/01

(52) U.S. Cl. ..... 5/627; 5/625; 5/81.1 T; 5/89.1

(58) Field of Search ..... 5/81.1 T, 89.1, 5/625, 627; 294/146

(56) References Cited

U.S. PATENT DOCUMENTS 879,335 A * 2/1908 Southmayd ..... 5/627
3,829,914 A * 8/1974 Treat ..... 5/81.1 T
5,048,133 A 9/1991 Iura et al.
5,179,746 A 1/1993 Rogers
5,283,919 A 2/1994 Grant
5,442,821 A * 8/1995 Weeks ..... 5/89.1
5,539,945 A 7/1996 Rosenberg et al.
5,577,281 A 11/1996 Mital et al.
D379,784 S 6/1997 Muhanna et al.
5,701,619 A 12/1997 Ullman
5,729,850 A 3/1998 Eskeli
5,839,137 A * 11/1998 Butler et al. ..... 5/627
5,978,989 A * 11/1999 Chavez ..... 5/627
D421,413 S 3/2000 Calkin
D424,799 S 5/2000 Lai
6,341,398 B1 1/2002 Heimbrock et al.
6,446,283 B1 9/2002 Heimbrock et al.

* cited by examiner

*Primary Examiner*—Michael Trettel
(74) *Attorney, Agent, or Firm*—Barnes & Thornburg LLP

(57) ABSTRACT

An emergency trauma stretcher comprised of flexible fabric such that the stretcher may be rolled or folded into a package for easy transport into locations where traditional stretchers are either not appropriate or not available. The stretcher is comprised of a support structure and handles. The support structure is comprised of longitudinal support members and lateral support members that are joined together at overlapping intersections. The handles are formed by looping the longitudinal and lateral support members at predetermined locations.

9 Claims, 1 Drawing Sheet

PACKABLE EMERGENCY TRAUMA STRETCHER

RELATED APPLICATION

This is the non-provisional filing of provisional application Ser. No. 60/328,382, filed on Oct. 11, 2001, entitled "Packable Emergency Trauma Stretcher."

BACKGROUND OF THE INVENTION

This invention relates to a device comprising a lightweight flexible fabric stretcher for transporting injured humans or animals. Every year seriously injured humans and animals require transport from an emergency trauma situation where conventional stretchers or litters are not appropriate. Disaster sites, soft wet soil or sand, swat situations and circumstances where further dangerous episodes may prevent the entry of conventional medical services but nonetheless require a fast method to retrieve the critically injured person or animal. In situations such as these where conventional transport is not available or appropriate, rescue personnel may resort to carrying the injured to safety in a manner that may result in further injuring the person or animal.

There is a need for a flexible fabric stretcher that can be rolled or folded into a package that can be slung over a person's shoulder, carried by an animal, or dropped from a helicopter or other rescue transport without damage. The flexible stretcher must have no parts that can be destroyed during the impact from an air-drop of 100 feet of altitude. The stretcher must also be capable of being carried by an adult traversing distances that may be in excess of 200 feet.

SUMMARY OF THE INVENTION

The invention provides a stretcher comprising a support structure for transporting a body. The support structure is comprised of first set of longitudinal support members and a second set of lateral support members perpendicular to the first set of longitudinal support members. The stretcher further comprises a plurality of handles about the perimeter of the support structure. The support members of the stretcher are comprised of fabric. The support members of the stretcher may be bound by nylon thread or a heat seal, and the stretcher is foldable about itself to form a compact package.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
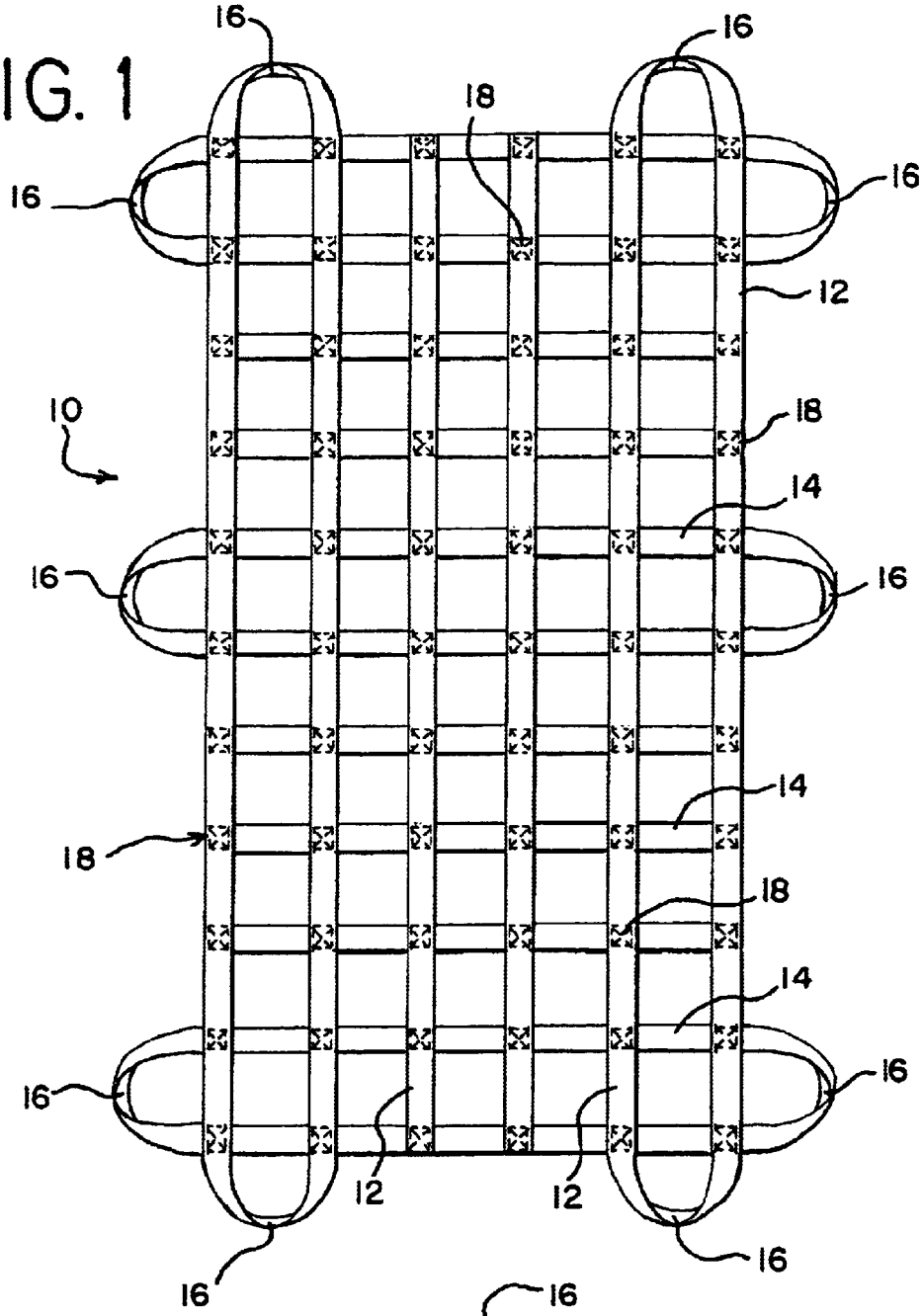
FIG. 1 is a top plan view of a first embodiment of the stretcher showing a lattice-like pattern of the support members and loop formation of the support members wherein the ends of the loops are used as handles.

For the purpose of promoting an understanding of the principles of the invention, reference will be made to the embodiments illustrated in the drawings. It will, nevertheless, be understood that no limitation of the scope of the invention is thereby intended, such alterations and further modifications in the illustrated device, and such further applications of the principles of the invention illustrated herein, being contemplated as would occur to the one skilled in the art to which the invention relates.

The stretcher 10, as shown in FIG. 1, is comprised of a lattice-like support structure also forming handles. The support structure is comprised of a first set of longitudinal support members 12 and a second set of lateral support members 14 that are perpendicular to the first set of longitudinal support members 12. The first set of longitudinal support members 12 and the second set of lateral support members 14 are comprised of natural or man-made synthetic fiber, rope or yarn form, or nylon strapping construction. The stretcher 10 can hold an adult human or animal, and can be carried by at least two persons. The first set of longitudinal support members 12 and the second set of lateral support members 14 are looped at a plurality of points about the perimeter of the stretcher 10 to form handles 16. Alternatively, a solid piece of fabric may be used to form the entire span of the stretcher 10 so long as the solid piece of fabric maintains the foldable and packagable properties of the stretcher 10.

The stretcher 10 is preferably held together by stitching the first set of longitudinal support members 12 and the second set of lateral support members 14 at overlapping intersections 18 with a nylon thread or the like. Alternatively, the intersections 18 may be stitched together with any material that will be strong enough to hold the stretcher 10 together when the weight of a human or animal is applied to the stretcher 10. Additionally, the intersections 18 may also be riveted, heat sealed or bonded by an adhesive so long as the bonding means is strong enough to hold the first set of longitudinal support members 12 and the second set of lateral support members 14 of the support structure 11 together when the weight of a human or animal is applied to the stretcher 10.

Figure 2:
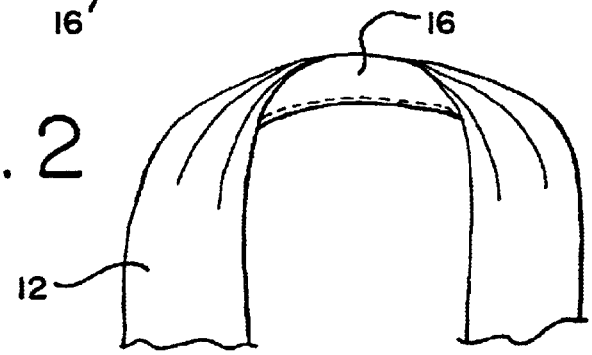
FIG. 2 is a top plan view of a first embodiment of a handle of the stretcher showing the support members gathered at the end of the loop to form a handle, which is shown as being stitched together.

FIG. 2 illustrates a close-up view of the handle 16 of the stretcher 10. The handles 16 are formed at the end of predetermined support members 12, 14 by gathering the support members 12, 14 in a manner to provide enhanced gripping capability. The handle 16 is preferably created by folding the first linear support member 12 or the second linear support member 14 in half and stitching the folded support member 12, 14 together with thread near the edges of the support member 12, 14. Alternatively, the handle 16 may be formed by way of heat seal or bonded by an adhesive so long as the bonding means is strong enough to hold the handle 16 together when the weight of a human or animal is applied to the stretcher 10. Additionally, the handles 16 may be formed by wrapping the first linear support member 12 or the second linear support member 14 around a flexible band made out of a material such as plastic or rubber. Alternatively, straps or shoulder harnesses may be hooked into the handles 16 thereby allowing fewer rescuers to carry a greater weight. Furthermore, the handles 16 may be larger than shown in the illustration so that they may be utilized in a variety of ways, such as being slung over the shoulder of one or more people.

Various features of the invention have been particularly shown and described in connection with the illustrated embodiments of the invention. However, it must be understood that these particular products, and their method of manufacture, do not limit but merely illustrate, and that the invention is to be given its fullest interpretation within the terms of the appended claims.

We claim:

1. A stretcher comprising:

a support structure for transporting a body;

the support structure comprising a first set of longitudinal flexible support members and a second act of lateral flexible support members perpendicular to and intersecting the first set of support members;

means fixedly connecting said support members at intersections thereof; and a plurality of handles about the perimeter of the support structure, said handles comprising integral portion of said second set of lateral flexible support members, said lateral flexible support members forming at least a pair of support members with said integral handles forming a contiguous extension spanning a gap between the pair of lateral flexible support members so as to bridge the support members to form the handles.

2. The stretcher according to claim 1 in which said support members are comprised of fabric.

3. The stretcher according to claim 1 in which said support members are bound together by thread at said intersections.

4. The stretcher according to claim 1 in which said support members are bound together by a heat seal at said intersections.

5. The stretcher according to claim 1 in which said stretcher is foldable about itself.

6. The stretcher according to claim 1 in which said support members are comprised of fabric.

7. The stretcher according to claim 1 in which said support members are bound together by thread at said intersections.

8. The stretcher according to claim 1 in which said support members are bound together by a heat seal at said intersections.

9. A packagable stretcher comprising:

a support structure for transporting a body;

the support structure comprising a first set of flexible support members and a second set of flexible support members perpendicular to and intersecting the first set of support members;

means connecting said support members at intersections thereof; and a plurality of handles about the perimeter of the support structure, said handles comprising integral portion of said second set of lateral flexible support members, said lateral flexible support members forming at least a pair of support members with said integral handles forming a contiguous extension spanning a gap between the pair of lateral flexible support members so as to bridge the support members to form the handles.

* * * * *